United States Patent [19]

Manini

[11] 4,428,252

[45] Jan. 31, 1984

[54] ACTUATOR DEVICE FOR OPENING A SLIDING DOOR

[76] Inventor: Giuseppe Manini, Via Malavasi, 26, Casalecchio Di Reno (Province of Bologna), Italy

[21] Appl. No.: 260,136

[22] Filed: May 4, 1981

[30] Foreign Application Priority Data

Nov. 19, 1979 [IT] Italy ..... 4995/79[U]

[51] Int. Cl.[3] ..... E05F 15/10

[52] U.S. Cl. ..... 74/625; 49/362; 464/39

[58] Field of Search ..... 74/625; 49/139, 362, 49/140; 464/37–39

[56] References Cited

U.S. PATENT DOCUMENTS

| | | | |
|---|---|---|---|
| 1,874,250 | 8/1932 | Decker | 464/39 |
| 2,151,493 | 3/1939 | Aclar | 74/625 |
| 2,548,847 | 4/1951 | Rossman et al. | 74/625 |
| 3,081,078 | 3/1963 | Lohr | 49/139 |
| 3,324,594 | 6/1967 | Hettinger et al. | 49/362 |
| 4,257,192 | 3/1981 | Bartholomew | 49/140 |

*Primary Examiner*—William F. Pate, III

*Attorney, Agent, or Firm*—Guido Modiano; Albert Josif

[57] ABSTRACT

An actuator device is disclosed for opening a sliding door comprises a casing or box in which a driven shaft is rotatably carried, wherewith are in rigid rotatory relationship a pinion gear meshing with a rack mounted on the sliding door and a helical gear wheel meshing with a worm screw keyed to a driveshaft driven by an electric motor housed in the casing and including a rotor carried on the driveshaft and arranged between a pair of plates one whereof is rigid with the driveshaft and the other whereof is rotatively coupled to but axially movable with respect to the driveshaft by means of a torque limiter.

2 Claims, 4 Drawing Figures

1
2
3
4
5
6
7
8
9
10
11
12
13
14
15
16
17
18
19
20
21
22
II
II

ACTUATOR DEVICE FOR OPENING A SLIDING DOOR

BACKGROUND OF THE INVENTION

This invention relates to an actuator device for opening a sliding door.

Known are horizontally sliding doors and gates the actuation whereof is controlled through an actuator device which comprises a worm and gear drive operative to transmit the motion from an electric motor to a pinion gear in constant mesh relationship with a rack attached to the door, thus causing the latter to move accordingly.

The problems encountered with such actuator devices include the provision of a safety system capable of stopping the door closing movement should a person get caught in it, and of manual door opening features in the event of the electric motor becoming inoperative owing to failure or electric power outage.

The solutions which have been proposed to the foregoing problems have failed to be completely satisfactory on account of the structural complexity which they introduce in the device.

SUMMARY OF THE INVENTION

This invention sets out to provide an actuator device which can solve such problems in a simple and reliable manner.

According to one aspect of the present invention, there is provided an actuator device for opening a sliding door, comprising a box wherein a driven shaft is rotatably carried, wherewith a pinion gear in mesh engagement with a rack mounted on the sliding door and helical gear wheel in mesh engagement with a worm screw keyed to a driveshaft driven by an electric motor housed in said box are rotatively rigid, characterized in that said electric motor comprises a rotor carried rotatably on said driveshaft and arranged between a pair of plates, one of said plates being rigid with said driveshaft and the other of said plates being rotatively coupled to but axially movable with respect to said driveshaft by means of a torque limiter comprising an adjustable spring adapted to cause said rotor to be clamped between said plates with a preset force.

BRIEF DESCRIPTION OF THE DRAWINGS

Further details will become more apparent from the following description of an embodiment of this invention, in conjunction with the accompanying illustrative drawings, where.

DESCRIPTION OF THE PREFERRED EMBODIMENTS

Figure 1:
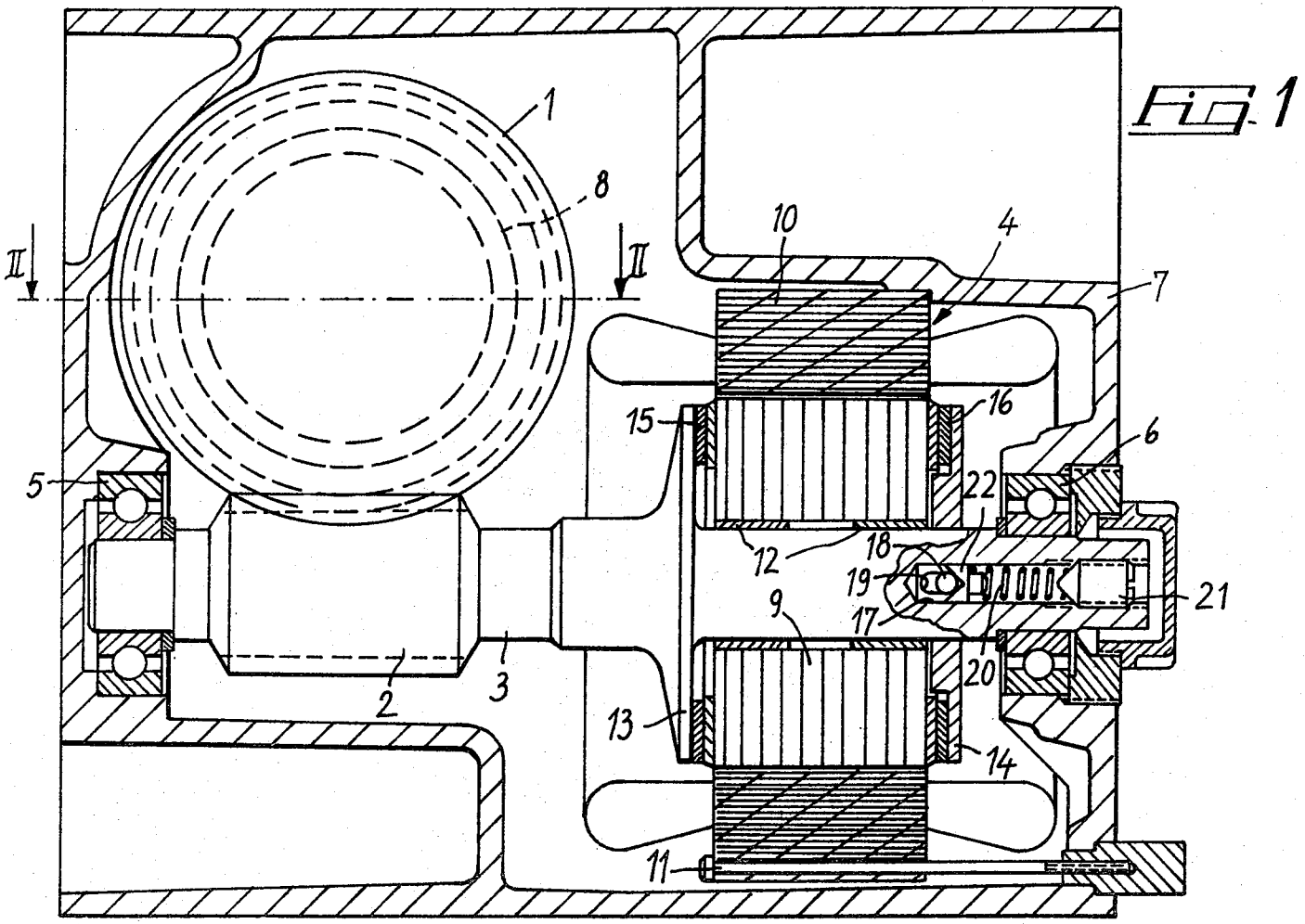
FIG. 1 is a sectional view of this device taken along the axis of the electric motor.
Figure 2:
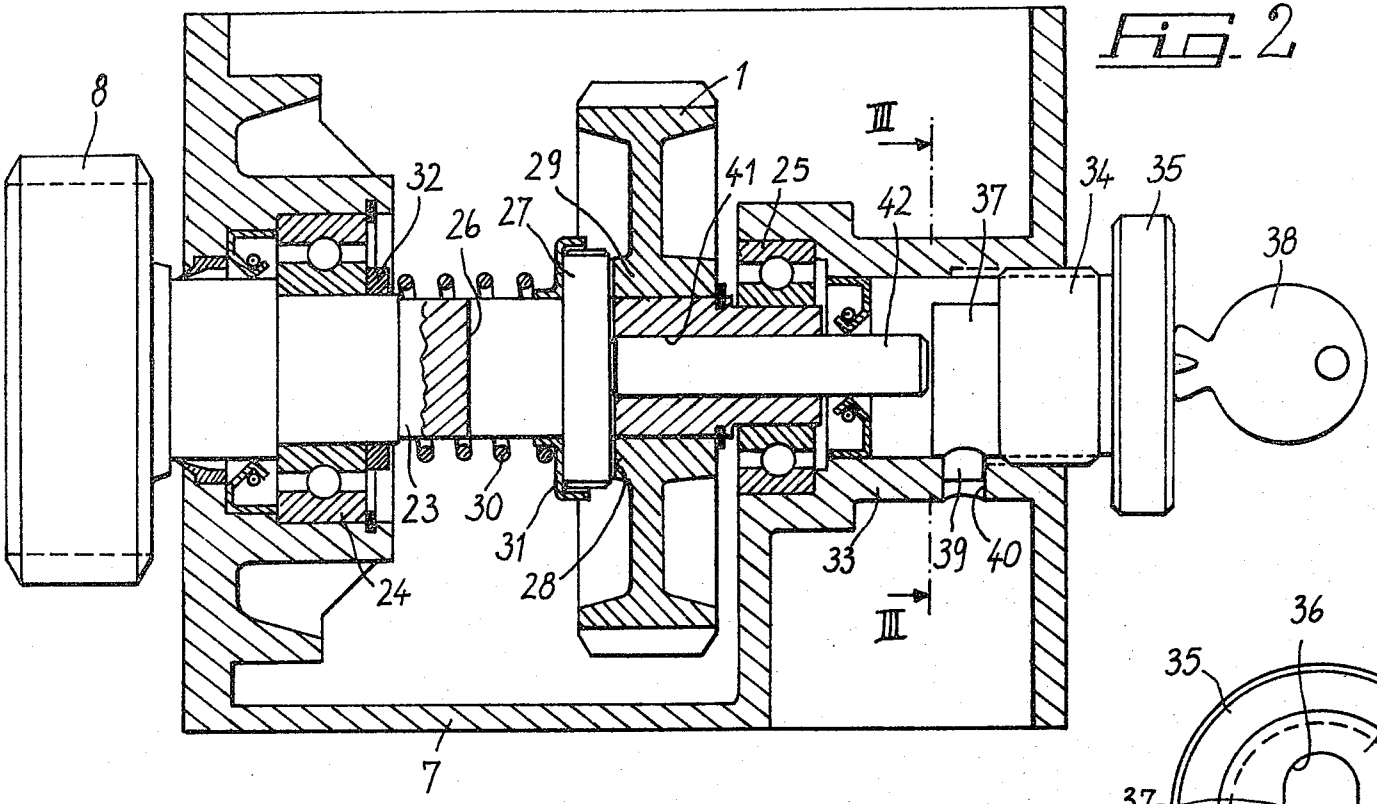
FIG. 2 is a sectional view taken in the plane II—II of FIG. 1.

The device illustrated comprises a drive including a helical gear wheel 1 and a worm screw 2 which is formed on the driveshaft 3 driven by an electric motor 4. The driveshaft 3 is rotatably carried, through bearings 5 and 6, in a box or casing 7. The electric motor 4 is of the reversible type and, through the drive 1,2, drives a pinion gear 8 which is in mesh engagement with a rack, not shown, made rigid with a door to be controlled.

On the driveshaft 3, is mounted the rotor 9 of the electric motor 4, the stator 10 whereof is secured in the box 7 by means of tie bolts 11. The rotor is allowed to rotate about the shaft 3 by means of intervening bushings 12 which also enable it to perform axial movements. The rotor is interposed between a pair of plates 13,14, the former whereof comprises a flange of the shaft 3 and the latter is mounted slidably on said shaft. Between the opposite faces of the rotor 9 and plates 13,14, rings 15,16 are interposed which are formed from a friction material.

At that end of the driveshaft 3 which carries the motor 4, there is provided an axial bore 17, wherethrough a pin 18 is inserted diametrically, the opposite ends whereof project outwardly from the shaft 3, through longitudinal slots 19, to radially engage in the plate 14. Thus, the plate 14 is made rotatively rigid with but axially slidable relatively to the driveshaft 3.

The plate 14 is urged to bear against the rotor by a spring 20 accommodated in the bore 17. The spring 20, at one end, abuts against an adjustment screw 21, and, at the other end, acts on a V-shaped pin 22 set astride the pin 19. It is noted that the spring 20 also serves as a torque limiter which can be adjusted by means of the screw 21, inasmuch as it limits the driving force of the shaft 3 to a value dependent on the compression of the spring 20 and frictional coefficient between the plates 13,14 and the opposite faces of the rotor 9.

The helical wheel 1 is rotatably carried on a second or driven shaft 23 which is journalled, by means of bearings 24,25, in the box 7 along an axis which extends perpendicularly to that of the shaft 3. To the end of the shaft 23 which protrudes out of the box, is keyed the cited pinion gear 8 which entrains the rack.

At the central area of the shaft 23, there is formed a diametrically throughgoing slot 26, wherethrough a pin 27 is inserted. The opposite ends of the pin 27 protrude out of the slot 25 and engage with a diametrical groove 28 on the hub 29 of the wheel 1. The pin is caused to bear against the hub 29 by a spring 30 mounted on the shaft 23 and bearing on the pin with the interposition of a cap 31 the peripheral edge whereof is turned up such as to prevent the pin from sliding off radially. The opposite end of the spring 30 abuts against a ring 32, which bears, in turn, against the bearing 24.

Figure 3:
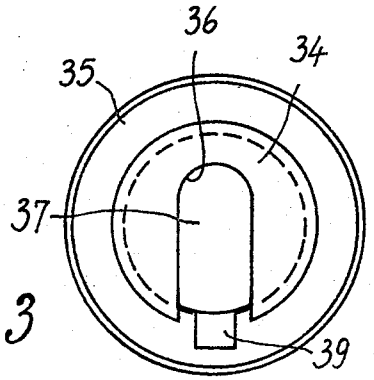
FIG. 3 is a view taken in the plane III—III of FIG. 2.

The box 7 is provided, axially to the shaft 23, with a sleeve or tubular portion 33, wherein a cylinder 34 is threaded which carries a ring nut 35. As may be seen in FIG. 3, the cylinder 34 has an axial cavity 36 accommodating a lock 37 to be operated by means of a flat key 38. The lock 37 has a radially movable bit 39, which engages, with the cylinder 34 partly threaded out of the tubular portion 33, in an opening 40 of the portion 33.

The shaft 23 is provided, at its remote end from the pinion gear 8, with an axial bore 41 which opens to the slot 26 and guides a stem 42 in sliding relationship therein.

The stem 42 has one end in contact with the pin 27 and the other end extended into the portion 33 as far as the lock 37.

The foregoing device operates in the following manner.

By operating the electric motor 4, through the drive 1,2, the pinion gear 8 is rotated and the door caused to open or close depending on the direction of rotation selected for the motor. In normal operating conditions, in fact, the rotor 9 is clamped between the plates 13,14, whilst the helical gear wheel 1 is made rotatively rigid with the shaft 23 by the pin 27 entering the groove 28.

Where, while the door is being closed, a foreign object happens to obstruct the free sliding movement of the door, there would occur an increase in the resisting couple such as to cause the rotor 9 to slip between the plates 13,14 and the shaft 3, and consequently the door itself, to stop moving.

By converse, where the door is to be opened manually, such as on account of a power outage, the wheel 1 is released from the shaft 23, thereby the pinion gear 8 is allowed to freewheel while remaining in mesh with the door rack. It is noted that it is mandatory that the wheel 1 be released, because the drive 1,2 cannot rotate when the door is to be moved manually. The wheel 1 is released by disengaging the bit 39 from the opening 40 by operation of the key 38 and threading the cylinder 34 into the tubular portion 33. The lock 37 will then contact the stem 42 which slides in the bore 41 and ejects the pin 27 from the groove 28 against the bias of the spring 30. Advantageously, the lock 37 is of the type wherein the bit 29 is biased outwardly by a spring which, upon threading the cylinder 34 out to its initial position, allows the bit to automatically engage with the opening 40 as the latter is moved into alignment therewith.

I claim:

1. An actuator device for opening a sliding door comprising a casing, a driven shaft rotatably carried in said casing, a pinion gear keyed on said driven shaft and in mesh engagement with a rack rigid with the sliding door, a drive shaft rotatably supported in said casing, an electric motor having a rotor mounted on said drive shaft to rotate with respect thereto and arranged between a pair of plates, one of said plate being rigid with said drive shaft and the other of said plates being rotatably coupled to but axially movable with respect to said driveshaft, an adjustable spring adapted to cause said rotor to be clamped between said plates with a preset force, a worm screw rigid with said drive shaft and in mesh engagement with an helical gear wheel mounted on said driven shaft, wherein according to the improvement said driven shaft has a diametrically throughout slot wherethrough a pin is inserted the opposite ends whereof project out of said slot and engage in a diametrical groove on the hub of the helical gear wheel, said pin being caused to bear against said hub by a spring bearing on said pin with the interposition of a cap, and wherein within the casing and coaxially with said driven shaft, there is formed a tubular portion threadably accommodating a cylinder provided with a ring nut and having a cavity for accommodating a lock therein, said lock including a radially movable bit operative, with said cylinder in a partly threaded out position, to engage with an opening in said tubular portion, in the end of said driven shaft adjacent said tubular portion there being formed an axial bore open on one side to said slot and on the other side to said tubular portion and wherethrough a stem is slidingly movable and effective to cause, with said cylinder in a threaded in position, said pin to disengage from said hub groove.

2. A device according to claim 1, wherein said driveshaft has an axial bore accommodating said spring abutting with one end against and adjustment screw threaded into said bore and with the other end acting on a pin extending diametrically across said bore and protruding outwards through longitudinal slots to radially engage with said movable plate.

* * * * *